US011661855B2

(12) United States Patent
Harner et al.

(10) Patent No.: US 11,661,855 B2
(45) Date of Patent: May 30, 2023

(54) LOW DENSITY HYBRID KNIFE SEAL

(71) Applicant: Raytheon Technologies Corporation, Farmington, CT (US)

(72) Inventors: John Harner, Vernon, CT (US); Kerry Lynn Davis, Wethersfield, CT (US); David J. Mathiau, East Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 17/509,418

(22) Filed: Oct. 25, 2021

(65) Prior Publication Data

US 2023/0131676 A1 Apr. 27, 2023

(51) Int. Cl.

| | |
|---|---|
| ***F01D 25/24*** | (2006.01) |
| ***F01D 11/12*** | (2006.01) |
| ***F01D 25/00*** | (2006.01) |

(52) U.S. Cl.

CPC ..... *F01D 11/125* (2013.01); *F01D 11/122* (2013.01); *F01D 25/005* (2013.01); *F01D 25/24* (2013.01); *F05D 2240/55* (2013.01); *F05D 2300/501* (2013.01); *F05D 2300/522* (2013.01); *F05D 2300/603* (2013.01); *F05D 2300/61* (2013.01)

(58) Field of Classification Search

CPC .... F01D 11/125; F01D 11/122; F01D 25/005; F01D 25/24; F05D 2240/55; F05D 2300/501; F05D 2300/522; F05D 2300/603; F05D 2300/61

See application file for complete search history.

(56) References Cited

U.S. PATENT DOCUMENTS

| | | | | |
|---|---|---|---|---|
| 3,547,455 | A * | 12/1970 | Edward | F16J 15/445 277/944 |
| 3,843,278 | A * | 10/1974 | Torell | F04D 29/526 415/173.4 |
| 4,269,903 | A * | 5/1981 | Clingman | C23C 4/18 428/471 |
| 4,299,865 | A * | 11/1981 | Clingman | F01D 11/122 427/247 |
| 4,349,313 | A * | 9/1982 | Munroe | F01D 11/125 415/196 |

(Continued)

FOREIGN PATENT DOCUMENTS

| | | |
|---|---|---|
| BE | 1023367 B1 | 2/2017 |
| DE | 102011004707 A1 | 8/2012 |

OTHER PUBLICATIONS

Kovacic, Jaroslav; Correlation between Young's Modulus and Porosity in Porous Materials; Jul. 1999; Journal of Materials Science Letters (Year: 1999).*

*Primary Examiner* — Igor Kershteyn
*Assistant Examiner* — Theodore C Ribadeneyra
(74) *Attorney, Agent, or Firm* — Bachman & LaPointe, P.C.

(57) ABSTRACT

A hybrid abradable seal including a stator substrate having an external surface; a casing coupled to the external surface, the casing including radial walls extending radially from the external surface; an abradable material disposed within the casing; the abradable material and the casing being coupled together and configured to resist a deflection responsive to engine gas loads.

15 Claims, 2 Drawing Sheets

(56) References Cited

U.S. PATENT DOCUMENTS 4,460,185 A * 7/1984 Grandey ..... F16J 15/445 415/173.4
5,951,892 A * 9/1999 Wolfla ..... F01D 11/122 219/121.85
10,280,783 B2 * 5/2019 Philbrick ..... F01D 11/122
10,494,945 B2 * 12/2019 Grande ..... C23C 4/126
10,900,371 B2 * 1/2021 Shi ..... F01D 11/122
2003/0170119 A1 * 9/2003 Fried ..... F01D 11/122 415/173.4
2012/0134774 A1 * 5/2012 Clark ..... B65D 51/14 415/9
2013/0108427 A1 * 5/2013 Brassine ..... B29C 45/16 415/200
2013/0177740 A1 * 7/2013 Merrill ..... B22F 5/009 427/535
2014/0271148 A1 * 9/2014 Dimelow ..... F01D 11/122 415/173.4
2015/0078893 A1 * 3/2015 Schmid ..... F16J 15/447 277/411
2015/0267556 A1 * 9/2015 Thomas ..... F01D 21/045 415/119
2015/0322809 A1 * 11/2015 Strock ..... F01D 5/288 415/173.4
2016/0003092 A1 * 1/2016 Chamberlain .... C04B 35/62222 428/323
2016/0146050 A1 * 5/2016 Molnar ..... F01D 25/24 415/213.1
2016/0201505 A1 * 7/2016 Clarkson ..... F02C 7/20 415/200
2016/0236995 A1 * 8/2016 Lai ..... B32B 18/00
2016/0305258 A1 * 10/2016 Strock ..... F01D 5/288
2016/0312897 A1 * 10/2016 Eastman ..... F16J 15/444
2017/0023013 A1 * 1/2017 Quillent ..... F01D 25/24
2017/0023023 A1 * 1/2017 Hiernaux ..... F04D 27/009
2017/0306783 A1 * 10/2017 Grande ..... C23C 4/131
2017/0314566 A1 * 11/2017 Strock ..... F04D 29/388
2017/0314570 A1 * 11/2017 Strock ..... F02C 3/04
2018/0149042 A1 * 5/2018 Freeman ..... F01D 25/246
2018/0306047 A1 * 10/2018 Seymour ..... F04D 29/083
2018/0361480 A1 * 12/2018 Le Biez ..... B22F 7/06
2018/0371932 A1 * 12/2018 Le Biez ..... B22F 5/009
2019/0032503 A1 * 1/2019 Shi ..... F01D 11/122
2019/0032504 A1 * 1/2019 Shi ..... F01D 11/12
2019/0160765 A1 * 5/2019 Le Hong ..... B29C 70/32
2019/0211705 A1 * 7/2019 Kling ..... B32B 3/28

* cited by examiner

LOW DENSITY HYBRID KNIFE SEAL

BACKGROUND

The present disclosure is directed to the improved low density hybrid knife seal.

Knife edge seals present issues during rub events as heat generated between the rotor tip and the seal material dramatically increases the temperature of the seal and associated rotor tip. Attempts to reduce the heat generated during rub events have produced abradable seals with lower density materials. Also, the abradable seal includes the use of precut trenches to allow for better heat transfer. The precut trenches along with the lower density materials have created a low elastic moduli in the cross section of the seal material. During operation, engine backpressure can deflect the abraded seal material causing the material to make further contact with the rotor.

What is needed is a structure that prevents the low density abradable seal materials from deflecting during engine operation.

SUMMARY

In accordance with the present disclosure, there is provided a hybrid abradable seal comprising a stator substrate having an external surface; a casing coupled to the external surface, the casing including radial walls extending radially from the external surface; an abradable material disposed within the casing; the abradable material and the casing being coupled together and configured to resist a deflection responsive to engine gas loads.

A further embodiment of any of the foregoing embodiments may additionally and/or alternatively include the casing includes a floor directly coupled to the exterior surface and coupled to the abradable material.

A further embodiment of any of the foregoing embodiments may additionally and/or alternatively include the abradable material comprises a silicone material with imbedded hollow microspheres.

A further embodiment of any of the foregoing embodiments may additionally and/or alternatively include the abradable material comprises a density of from about 0.5 to about 0.65 grams/cubic centimeter.

A further embodiment of any of the foregoing embodiments may additionally and/or alternatively include the hybrid abradable seal further comprising a mechanical fastener configured to attach at least one of the casing and the abradable material to the stator substrate.

A further embodiment of any of the foregoing embodiments may additionally and/or alternatively include the casing comprises radial walls extending radially from the exterior surface and configured to contain the abradable material within the radial walls, relative to an axis A.

A further embodiment of any of the foregoing embodiments may additionally and/or alternatively include the casing and the abradable material comprise a ratio of elastic modulus of casing to abradable of about 50-5000 X.

In accordance with the present disclosure, there is provided a hybrid abradable seal for a gas turbine engine rotor and stator comprising a stator substrate having an external surface; a casing coupled to the external surface, the casing including radial walls extending radially from the external surface; an abradable material disposed within the casing radial walls relative to an axis A; the abradable material and the casing being coupled together and configured to resist a deflection responsive to gas turbine engine gas loads.

A further embodiment of any of the foregoing embodiments may additionally and/or alternatively include the casing includes a floor directly coupled to the exterior surface and coupled to the abradable material.

A further embodiment of any of the foregoing embodiments may additionally and/or alternatively include the casing comprises a material selected from the group consisting of polyether ketone, polyether ether ketone, polyetherimide, polyamide imide, polyphenylene sulfide or polyphenylsulfone and a reinforced thermoset organic matrix composite such as an epoxy or imide-based resin reinforced with carbon or glass fibers or fabric.

A further embodiment of any of the foregoing embodiments may additionally and/or alternatively include the reinforced thermoset organic matrix composite is selected from the group consisting of an epoxy or imide-based resin reinforced with at least one of a carbon fiber, a glass fiber and a fabric.

A further embodiment of any of the foregoing embodiments may additionally and/or alternatively include the casing comprises neat or reinforced thermoplastic.

A further embodiment of any of the foregoing embodiments may additionally and/or alternatively include the abradable material comprises a silicone material with imbedded hollow microspheres to form an abradable material density of from about 0.5 to about 0.65 grams/cubic centimeter.

In accordance with the present disclosure, there is provided a gas turbine engine abradable seal deflection reduction process comprising providing a stator substrate having an external surface; coupling a casing to the external surface, the casing including radial walls extending radially from the external surface; disposing an abradable material within the casing radial walls relative to an axis A; coupling the abradable material and the casing together being configured to resist a deflection responsive to gas turbine engine gas loads.

A further embodiment of any of the foregoing embodiments may additionally and/or alternatively include the casing includes a floor directly coupled to the exterior surface; and coupling the floor to the abradable material.

A further embodiment of any of the foregoing embodiments may additionally and/or alternatively include the abradable material comprises a silicone material with imbedded hollow microspheres to form an abradable material density of from about 0.5 to about 0.65 grams/cubic centimeter.

A further embodiment of any of the foregoing embodiments may additionally and/or alternatively include the casing and the abradable material comprise a ratio of elastic modulus of casing to abradable of about 50-5000 X.

A further embodiment of any of the foregoing embodiments may additionally and/or alternatively include the process further comprising fabricating the abradable seal in-situ with low modulus abradable material loaded and cured into the casing following installation of the abradable seal.

A further embodiment of any of the foregoing embodiments may additionally and/or alternatively include the casing comprises neat or reinforced thermoplastic.

A further embodiment of any of the foregoing embodiments may additionally and/or alternatively include process further comprising forming channels into the abradable material.

Other details of the low density hybrid knife seal are set forth in the following detailed description and the accompanying drawings wherein like reference numerals depict like elements.

DETAILED DESCRIPTION

Figure 1:
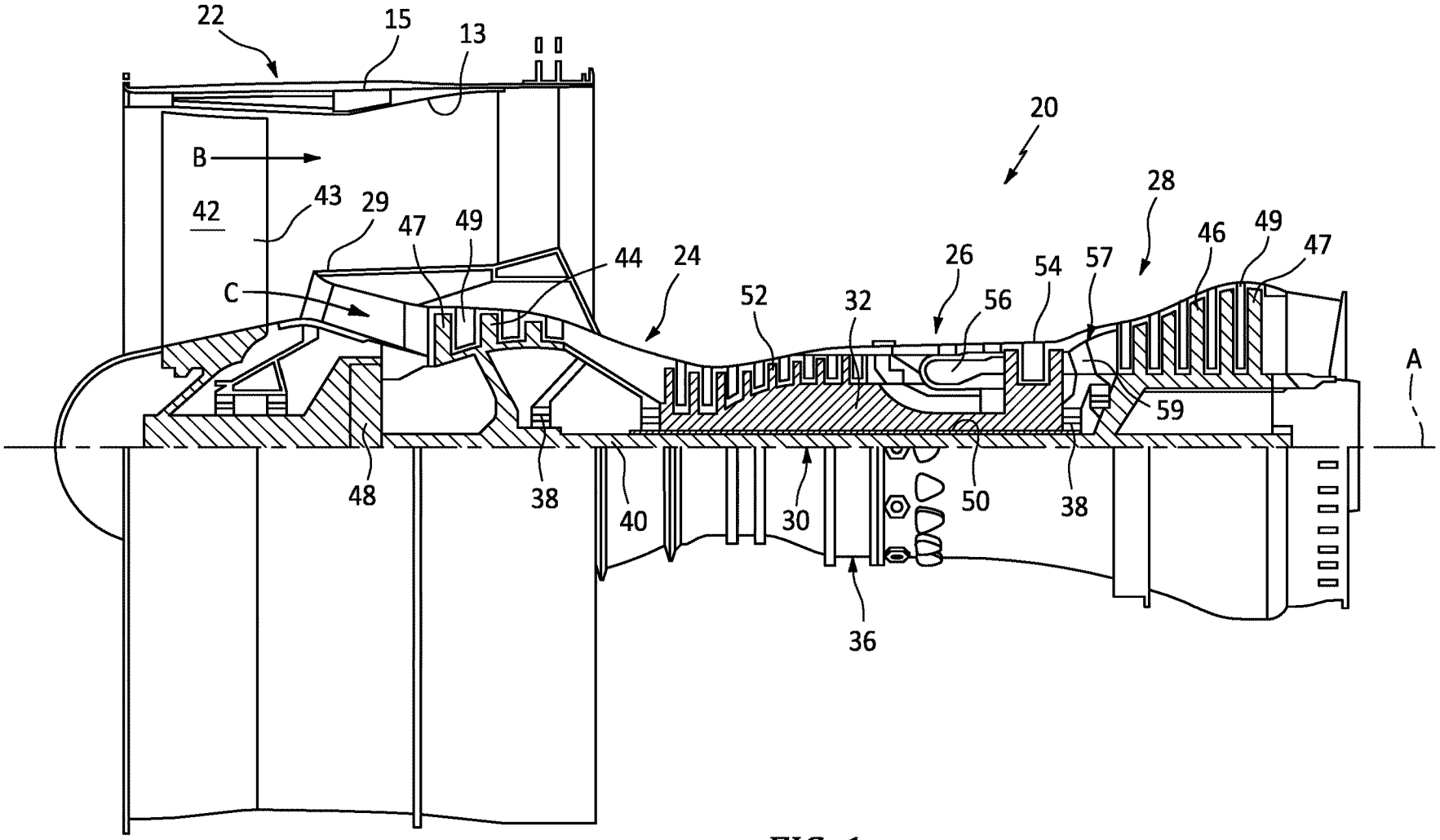
FIG. 1 is a schematic longitudinal sectional view of a turbofan engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 may include a single-stage fan 42 having a plurality of fan blades 43. The fan blades 43 may have a fixed stagger angle or may have a variable pitch to direct incoming airflow from an engine inlet. The fan 42 drives air along a bypass flow path B in a bypass duct 13 defined within a housing 15 such as a fan case or nacelle, and also drives air along a core flow path C for compression and communication into the combustor section 26 then expansion through the turbine section 28. A splitter 29 aft of the fan 42 divides the air between the bypass flow path B and the core flow path C. The housing 15 may surround the fan 42 to establish an outer diameter of the bypass duct 13. The splitter 29 may establish an inner diameter of the bypass duct 13. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in the exemplary gas turbine engine 20 is illustrated as a geared architecture 48 to drive the fan 42 at a lower speed than the low speed spool 30. The inner shaft 40 may interconnect the low pressure compressor 44 and low pressure turbine 46 such that the low pressure compressor 44 and low pressure turbine 46 are rotatable at a common speed and in a common direction. In other embodiments, the low pressure turbine 46 drives both the fan 42 and low pressure compressor 44 through the geared architecture 48 such that the fan 42 and low pressure compressor 44 are rotatable at a common speed. Although this application discloses geared architecture 48, its teaching may benefit direct drive engines having no geared architecture. The high speed spool 32 includes an outer shaft 50 that interconnects a second (or high) pressure compressor 52 and a second (or high) pressure turbine 54. A combustor 56 is arranged in the exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

Airflow in the core flow path C is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core flow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The low pressure compressor 44, high pressure compressor 52, high pressure turbine 54 and low pressure turbine 46 each include one or more stages having a row of rotatable airfoils. Each stage may include a row of static vanes adjacent the rotatable airfoils. The rotatable airfoils and vanes are schematically indicated at 47 and 49.

The engine 20 may be a high-bypass geared aircraft engine. The bypass ratio can be greater than or equal to 10.0 and less than or equal to about 18.0, or more narrowly can be less than or equal to 16.0. The geared architecture 48 may be an epicyclic gear train, such as a planetary gear system or a star gear system. The epicyclic gear train may include a sun gear, a ring gear, a plurality of intermediate gears meshing with the sun gear and ring gear, and a carrier that supports the intermediate gears. The sun gear may provide an input to the gear train. The ring gear (e.g., star gear system) or carrier (e.g., planetary gear system) may provide an output of the gear train to drive the fan 42. A gear reduction ratio may be greater than or equal to 2.3, or more narrowly greater than or equal to 3.0, and in some embodiments the gear reduction ratio is greater than or equal to 3.4. The gear reduction ratio may be less than or equal to 4.0. The fan diameter is significantly larger than that of the low pressure compressor 44. The low pressure turbine 46 can have a pressure ratio that is greater than or equal to 8.0 and in some embodiments is greater than or equal to 10.0. The low pressure turbine pressure ratio can be less than or equal to 13.0, or more narrowly less than or equal to 12.0. Low pressure turbine 46 pressure ratio is pressure measured prior to an inlet of low pressure turbine 46 as related to the pressure at the outlet of the low pressure turbine 46 prior to an exhaust nozzle. It should be understood, however, that the above parameters are only exemplary of one embodiment of a geared architecture engine and that the present invention is applicable to other gas turbine engines including direct drive turbofans. All of these parameters are measured at the cruise condition described below.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft. (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above, and those in the next paragraph are measured at this condition unless otherwise specified.

"Low fan pressure ratio" is the pressure ratio across the fan blade 43 alone, without a Fan Exit Guide Vane ("FEGV") system. A distance is established in a radial direction between the inner and outer diameters of the bypass duct 13 at an axial position corresponding to a leading edge of the splitter 29 relative to the engine central longitudinal axis A. The low fan pressure ratio is a span-wise average of the pressure ratios measured across the fan blade 43 alone over radial positions corresponding to the distance. The low fan pressure ratio can be less than or equal to 1.45, or more narrowly greater than or equal to 1.25, such as between 1.30 and 1.40. "Low corrected fan tip speed" is the actual fan tip speed in feet/second divided by an industry standard temperature correction of $[(\text{Tram}\ ^\circ\ \text{R}) / (518.7^\circ\ \text{R})]^{0.5}$. The "low corrected fan tip speed" can be less than or equal to 1150.0 feet/second (350.5 meters/second), and greater than or equal to 1000.0 feet/second (304.8 meters/second).

Figure 2:
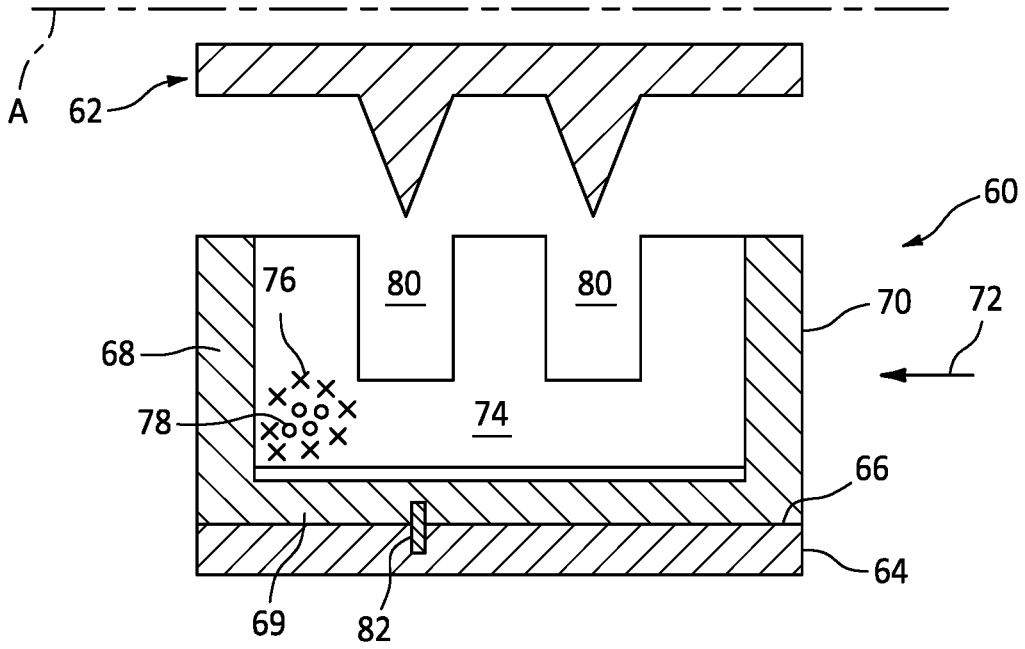
FIG. 2 is a cross sectional schematic of an exemplary abradable seal.
Figure 3:
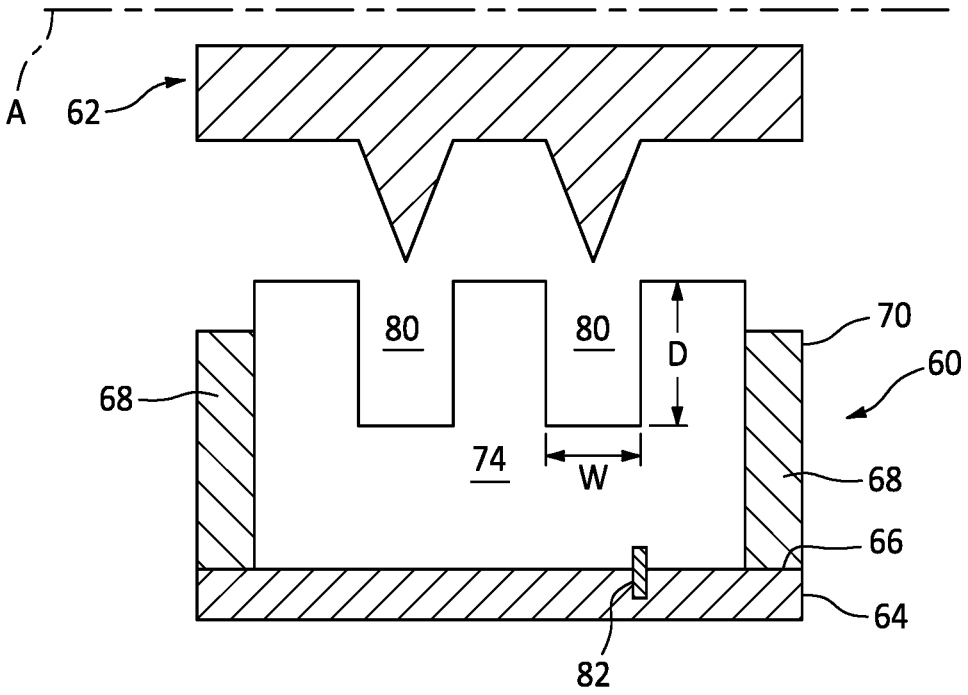
FIG. 3 is a cross sectional schematic of an exemplary abradable seal.

Referring also to FIG. 2 and FIG. 3, a seal 60 is shown. The seal 60 can be an abradable seal 60 proximate a knife edge rotor 62. The rotor 62 rotates around axis A. The abradable seal 60 is configured to interact with the rotor 62 and provide a sealing function. The knife edge rotor 62 can interact with the abradable seal 60 and can cause wear to the abradable seal 60.

The abradable seal 60 includes a stator substrate 64. The substrate 64 has an exterior surface 66. A casing 68 can be disposed on the exterior surface 66. The casing 68 can be a material that includes a stiffness that resists deflection. In an exemplary embodiment, the casing 68 material can include a thermoplastic. In another exemplary embodiment, the casing 68 can include neat or reinforced thermoplastic such as but not limited to polyether ketone, polyether ether ketone, polyetherimide, polyamide imide, polyphenylene sulfide or polyphenylsulfone or a reinforced thermoset organic matrix composite such as an epoxy or imide-based resin reinforced with carbon or glass fibers or fabric. The casing 68 can include an optional floor 69, as shown in FIG. 2. The casing 68 can include radial walls 70. The radial walls 70 can be range from about 0.050 to about 0.25 inches thick. This thickness provides the necessary support to withstand the deflection induced by the internal air flow forces 72.

A low density abradable material 74 can be disposed within the casing 68. The abradable material 74 can be partially disposed within the casing 68 and axially contained within the radial walls 70, relative to axis A. The abradable material 74 can be exposed to the rotor 62 with no casing 68 between the rotor 62 and abradable material 74. The abradable material 74 can be disposed directly onto the exterior surface 66, in an exemplary embodiment, when there is no casing floor 69, as shown in FIG. 3. The abradable material 74 can include low elastic moduli. The abradable material 74 can comprise a lightweight abradable with imbedded hollow carbon or glass microspheres creating a material with a density of from about 0.5 to about 0.65 grams/cubic centimeter. In an exemplary embodiment, the casing 68 can relate to the abradable material 74 with a ratio of elastic modulus of casing to abradable of about 50-5000 X.

In an exemplary embodiment, the abradable material 74 consisting of silicone 76 filled to a high volume percentage of hollow microspheres 78 creates an overall low density material which has shown to significantly reduce the evolved temperature during rub events. Higher concentrations of microspheres 78 perform the best as elimination of compressible elastomer reduces heat generation. The high volume or high concentration of microspheres can be the range of 50-70% microspheres by volume.

In an exemplary embodiment, the abradable seal 60 can include channels 80 cut into the abradable material 74. The depth D and width W of the channels 80 can be predetermined dimensions. In an exemplary embodiment, the width D can range from 0.15-0.30 inches; the depth D can range from 0.125-0.50 inches. The channels 80 can be cut to prevent any rub of the seal 60 which prevents heat build-up.

The use of the low density abradable material 74 can avoid the use of pre-cut channels 80. As the seal 60 is abraded, trenches will be formed by the rotor 62 however these trenches will be much smaller than pre-cut channels 80, as the trenches are a perfect fit for the rotor 62. Pre-cut channels 80 have to take up all the build tolerances and so they are quite a bit wider. This causes inefficiencies in the engine. The low density material 74 could also have pre-cut channels but overall may not be necessary, as the abradable material 74 can accommodate in-situ rotor 62 trenching.

With the extreme low density of the abradable material 68, channeled seals may not withstand engine gas loads 72 causing the abradable seal 60 to deflect axially into a rotor tip (not shown) causing additional rub. The combination of the radial walls 70 and the abradable material 74 coupled together provide a load 72 resistant structure. In an exemplary embodiment the casing walls 70 need not be as high as the contained abradable material 74, as shown in FIG. 3, and thus radially extend along a portion of the abradable material 74.

In an exemplary embodiment, at least one of the abradable material 74 and the casing 68 can be attached to the stator substrate 64 via an imbedded mechanical fastener 82. The abradable seal 60 can be fabricated in-situ with low modulus material 74 loaded and cured into the casing 68 following installation of the seal 60.

A technical advantage of the disclosed abradable seal includes the hybrid seal uses a thermoplastic casing which provides necessary stiffness to resist deflection and prevent any additional rub.

A technical advantage of the disclosed abradable seal includes the elastomeric nature of the material which provides toughness to the bonded element preventing brittle crack growth due to thermal expansion mismatch.

A technical advantage of the disclosed abradable seal includes a hybrid design which provides a way to reduce seal weight and to permit rub in seals which previously were pre-trenched to eliminate the issue of overheating.

A technical advantage of the disclosed abradable seal includes a rub system that gains efficiency over current pre-trenched designs.

A technical advantage of the disclosed abradable seal includes the walled casing being configured to bond the low density filler to the casing. The adhesive bond creates additional benefit from deflection.

There has been provided a low density hybrid knife seal. While the low density hybrid knife seal has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A hybrid abradable seal comprising:

a stator substrate having an external surface;

a casing coupled to said external surface, said casing including radial walls extending orthogonal radially from said external surface;

an abradable material disposed within the casing, said abradable material comprises a silicone material with imbedded hollow microspheres, wherein said abradable material comprises a density of from 0.5 to 0.65 grams/cubic centimeter;

said abradable material and said casing being coupled together and configured to resist a deflection responsive to engine gas loads.

2. The hybrid abradable seal according to claim 1, wherein said casing includes a floor directly coupled to said exterior surface and coupled to said abradable material.

3. The hybrid abradable seal according to claim 1, further comprising a mechanical fastener configured to attach at least one of said casing and said abradable material to said stator substrate.

4. The hybrid abradable seal according to claim 1, wherein said radial walls extending orthogonal radially from said exterior surface are configured to contain said abradable material within the radial walls, relative to an axis A.

5. The hybrid abradable seal according to claim 1, wherein said casing and said abradable material comprise a ratio of elastic modulus of casing to abradable of 50-5000 X.

6. A hybrid abradable seal for a gas turbine engine rotor and stator comprising:

a stator substrate having an external surface;

a casing coupled to said external surface, said casing including radial walls extending orthogonal radially from said external surface;

an abradable material disposed within the casing radial walls relative to an axis A, wherein said abradable material comprises a silicone material with imbedded hollow microspheres to form an abradable material density of from 0.5 to 0.65 grams/cubic centimeter;

said abradable material and said casing being coupled together and configured to resist a deflection responsive to gas turbine engine gas loads.

7. The hybrid abradable seal for a gas turbine engine rotor and stator according to claim 6, wherein said casing includes a floor directly coupled to said exterior surface and coupled to said abradable material.

8. The hybrid abradable seal for a gas turbine engine rotor and stator according to claim 6, wherein said casing comprises a material selected from the group consisting of polyether ketone, polyether ether ketone, polyetherimide, polyamide imide, polyphenylene sulfide or polyphenylsulfone and a reinforced thermoset organic matrix composite such as an epoxy or imide-based resin reinforced with carbon or glass fibers or fabric.

9. The hybrid abradable seal for a gas turbine engine rotor and stator according to claim 8, wherein said reinforced thermoset organic matrix composite is selected from the group consisting of an epoxy or imide-based resin reinforced with at least one of a carbon fiber, a glass fiber and a fabric.

10. The hybrid abradable seal for a gas turbine engine rotor and stator according to claim 6, wherein said casing comprises neat or reinforced thermoplastic.

11. A gas turbine engine abradable seal deflection reduction process comprising:

providing a stator substrate having an external surface;

coupling a casing to said external surface, said casing including radial walls extending orthogonal radially from said external surface;

disposing an abradable material within the casing radial walls relative to an axis A, wherein said abradable material comprises a silicone material with imbedded hollow microspheres to form an abradable material density of from about 0.5 to about 0.65 grams/cubic centimeter;

coupling said abradable material and said casing together being configured to resist a deflection responsive to gas turbine engine gas loads, wherein said casing and said abradable material comprise a ratio of elastic modulus of casing to abradable of 50-5000 X.

12. The process of claim 11, wherein said casing includes a floor directly coupled to said exterior surface; and coupling said floor to said abradable material.

13. The process of claim 11, further comprising:

fabricating said gas turbine engine abradable seal in-situ with low modulus abradable material loaded and cured into the casing following installation of the abradable seal.

14. The process of claim 11, wherein said casing comprises neat or reinforced thermoplastic.

15. The process of claim 14, further comprising:

forming channels into the abradable material.

* * * * *